US010413811B2

(12) United States Patent
Amatucci

(10) Patent No.: US 10,413,811 B2
(45) Date of Patent: Sep. 17, 2019

(54) MOP HEAD

(75) Inventor: Josephine Amatucci, Wolfeboro, NH (US)

(73) Assignee: Josephine Amatucci, Wolfeboro Falls, NH (US)

( * ) Notice: Subject to any disclaimer, the term of this patent is extended or adjusted under 35 U.S.C. 154(b) by 1010 days.

(21) Appl. No.: 10/880,067

(22) Filed: Jun. 29, 2004

(65) Prior Publication Data

US 2005/0283934 A1 Dec. 29, 2005

(51) Int. Cl.
*A47L 13/20* (2006.01)
*A63F 13/20* (2014.01)

(52) U.S. Cl.
CPC ..... *A63F 13/20* (2014.09)

(58) Field of Classification Search
USPC ..... 15/228, 247; 300/21
See application file for complete search history.

(56) References Cited

U.S. PATENT DOCUMENTS

| | | | | | |
|---|---|---|---|---|---|
| 960,158 | A | * | 5/1910 | Cummings et al. | 15/247 |
| 1,929,082 | A | * | 10/1933 | Simon | 15/247 |
| 2,269,424 | A | * | 1/1942 | Bernstein | 15/228 |
| 2,709,824 | A | * | 6/1955 | Hall | 15/247 |
| 2,815,521 | A | * | 12/1957 | Winckler | 15/118 |
| 2004/0158951 | A1 | * | 8/2004 | Smith et al. | 15/247 |

FOREIGN PATENT DOCUMENTS

| | | | |
|---|---|---|---|
| DE | 4321596 | * | 1/1995 |
| GB | 2255900 | * | 11/1992 |
| WO | 02/094079 | * | 11/2002 |

* cited by examiner

*Primary Examiner* — Mark Spisich

(57) ABSTRACT

A mop head that attached to a mop handle with a number of functional parts. A padded cloth added to give more padding to the back of the mop head, a wrap that prevents scratching of the floor by wrapping around and covering the plastic or metal parts of a mop handle, two pieces of Velcro that secure wrap closed, a narrow mesh stitched to the bottom edge to strengthen bottom edge, a wide mesh that scrapes off tough dirt from floor and a flap that fits inside the mechanism of a mop handle. The mechanism receives and holds the mop head securely to the mop handle and a bottom mopping section.

2 Claims, 1 Drawing Sheet

MOP HEAD

BACKGROUND OF THE INVENTION

This invention relates to implements used to ease housework chores especially in regards to washing floors.

FIELD OF THE INVENTION

The mops available in the marketplace are the string mops, the sponge mops, the mop covers, and the disposable cloths, as far as known. These products have been around a long time except for the disposable cloths, and the consumer has long been disenchanted with these unattractive and inefficient products.

In all prior art the metal and plastic mechanisms of the mop handle are not covered completely, allowing no complete protection from scratching and scraping of the surface being cleaned.

Mounting and dismounting in prior art is very time consuming and tedious. To mount the string models required that the person grabs a bunch of strings and weaves them in the spring of the handle, and because there are a lot of strings it takes a long time for the task. In the string models that have a clamp for mounting, the person has to hold down the clamp and at the same time fit the thick top of the mop inside, which is very awkward and difficult. The sponge models and the mop covers have screws and snaps for mounting to a bulky frame. It is very time consuming and awkward to screw the screws on, and it is frustrating and not suited for certain age groups. The snaps are also frustrating and not suited for certain age groups. The snaps are also frustrating because they are hard to press down and close.

To dismount, the string models require that the person pulls out the dirty strings from the string of the handle with his hands, which is unpleasant and disgusting chore. The string models that are secured to the handle with a clamp are very difficult to handle as the clamp is hard to press down, and at the time dislodge the bulky mop head. The sponge models and mop covers have screws that have to be unscrewed, or snaps that have to be unsnapped. The screws are hard to unscrew, and the snaps have to be yanked free because they are difficult to unsnap. These are not chores that certain age groups can handle easily.

None of the prior art cleans well. The disadvantage of all mops is their inability to clean in edges, corners and under cabinets. The person has to stop to clean these areas with an extra cloth. The bulky and awkward frames of the sponge models and mop covers make it impossible to get into these areas. The string models are too heaving and awkward to push into these areas, and the strings separate and streak when cleaning requiring extra passes across the floor. They also trap dirt which is hard to remove even when the mop is washed. The sponge mops just push the dirt from one place to another. They do not pick up the dirt, and the sponge mope have a small mopping surface which takes a long time to clean the entire floor. The disposable mops are too costly to buy and consumer has to use several cloths to mop a floor, which makes them not practical, and unaffordable for the consumer who cannot afford such luxury.

Prior art does not offer the variety of colors, plaids, or prints.

Accordingly, several objects and advantages of the present invention are:

(a) to provide a mop that protects against scratching and scraping of the surface being cleaned with a unique top wraparound design that covers the plastic and metal of a mop handle, to prevent against scratching of the floor;

(b) to provide a mop that is easy to mount and dismount. A flap provides easy and fast mounting and dismounting;

(c) to provided a mop with cleaning abilities unsurpassed in all prior art. This present invention snakes into corners, edges and under cabinets. Because it is lightweight, Has a nice compact flat ample surface, no bulky frame that gets in the way, and no long bulky strings that are hard to push into these areas. It has not strings, so it does not trap dirt, it does not streak, and requires only one pass across the floor. It does not push from one place to another, it picks up the dirt. The ample mopping surface makes it easy and fast to clean the surface; and (d) to provide a mop that will be available in all colors, plaids, and prints, which is a novel idea for a mop, and because the mop can be made with a towel, a new use for a terry cloth product that the consumer already loves.

Accordingly, the reader will see that the present invention surpasses all other mops in outstanding features and performance as it has the advantages in that:

- it provides for easy mounting and dismounting, suitable for all age groups;
- it provides a top wrap section that covers the metal and plastic mechanisms of the handle, preventing scratching and scraping of the surface;
- it provides a mop that will be available in a variety of colors, plaids, and prints which has decorating and eye appeal, which in turn refreshes the spirit, making the job of mopping a little more pleasant;
- it provides unsurpassed cleaning performance with its ability to clean in all areas, such as corners, edges and under counters. It has no strings that streak and separate when washing, it has no bulky frame that makes it impossible to get in all areas when cleaning. It has a lat ample surface, is lightweight, and snakes into corners, edges and under counters with one pass; and
- it provides a product that can be made with terry cloth fibers, which is a cloth that consumers are familiar with, a cloth with proven durability, softness and a dependable cleaning product, and it gives a new use for something the consumer already knows and loves.

Although the above description contains many specifications, these should not be construed as limiting the scope of the invention. For example, the top wrap around section and the flap can be eliminated or duplicated. The mop can be changed in size either smaller or larger, it can be made or a different material, shape, and size, and color. It can be connected or associated with it adjacent elements, in a different manner, it can be given a different mode or function of operation, or it can be made integrally or trapezoidal, triangular, etc., the mop and all embodiments. It can have one fold, no fold, or many folds, it can be one piece of material or many for all embodiments.

SUMMARY OF THE INVENTION

In accordance with the present invention a mop head that attached to a mop handle, mop head has seven functionally parts, a cloth doubled over is added to form a more padded mopping section in the back, a wrap section that prevents scratching of the floor by wrapping around and covering the plastic or metal parts of a mop handle such as a spring and lever, two pieces of Velcro to hold the wrap together, a narrow piece of mesh attached to a bottom edge to stabilize the bottom edge, a flap that fits into the mechanism of a mop handle holding mop head securely to the mop handle, and a wide piece of mesh added to the top edge to scrape off tough dirt from the floor, and a bottom mopping section.

BRIEF DESCRIPTION OF THE DRAWINGS

The present invention will become apparent in the light of the following with reference to the accompanying drawings, wherein:

FIG. 3 shows constructing of the bottom mopping section;

DETAILED DESCRIPTION OF THE INVENTION

Figure 1:
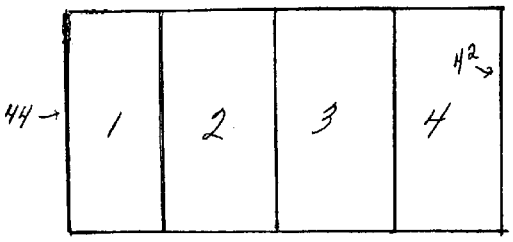
FIG. 1 shows four adjacent panels.
Figure 2:
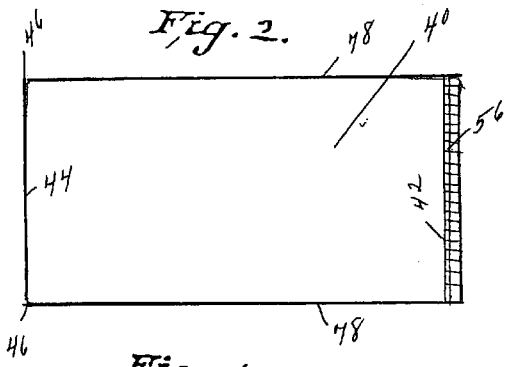
FIG. 2 shows a towel approximately 13" by 24"
Figure 3:
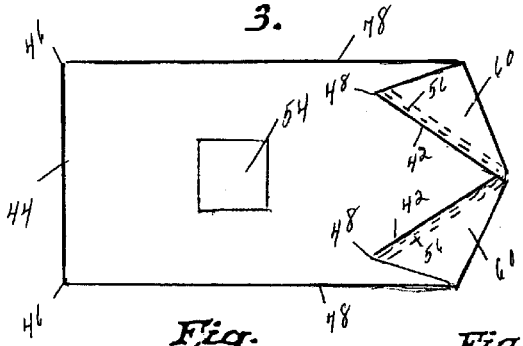
FIG. 3 shows a padded cloth stitched on towel and the construction of a flap with mesh attached to bottom edge.
Figure 4:
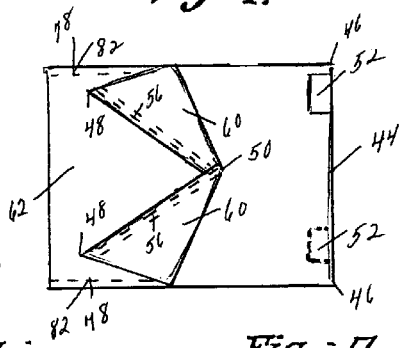
FIG. 4 shows constructing of the bottom mopping section.
Figure 5:
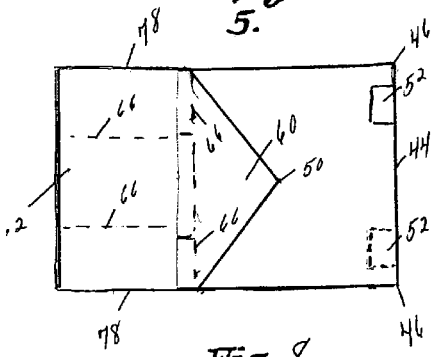
FIG. 5 shows a pattern of stitching securing the top of towel to bottom of towel, with a line straight across and two lines down on sides of padded cloth.
Figure 6:
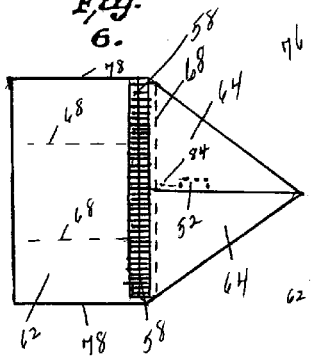
FIG. 6 shows the construction of the wrap section.
Figure 7:
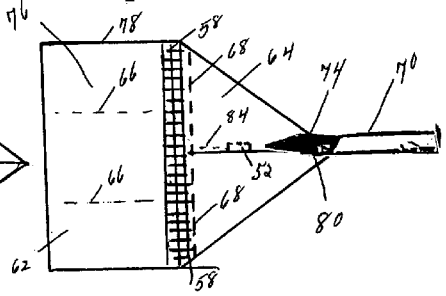
FIG. 7 shows a constructed mop head mounted on a mop handle.
Figure 8:
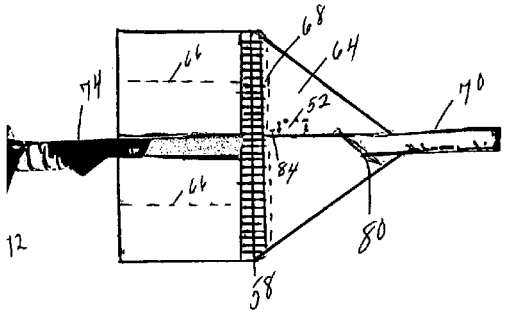
FIG. 8 shows the first step of a mop head being mounted to a mop handle by first placing the handle under the wrap section and out through the top opening.
Figure 9:
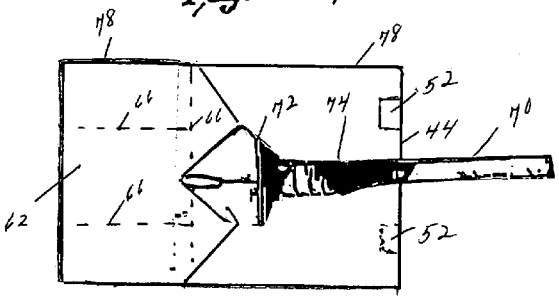
FIG. 9 shows the second step of mounting the mop head to a mop handle, in an open view, by fitting the flap inside spring of mop handle and securing lever closed.

The present invention consists of a mop head 76 (FIG. 7) constructed from a cloth preferably terry cloth fibers such as towel 40 (FIG. 2) approximately 13 inches by 24 inches but can vary in size, said mop head is designed to attach to a mop handle 70 with a spring 72 and lever 74 (FIG. 9), said mop head has seven functional parts, a padded cloth 54 (FIG. 3) approximately 5½ inches by 12½ inches of preferably terry cloth fibers, stitched to a side of towel for a more padded mopping section, a wrap 64 (FIG. 7) that wraps around and covers the spring and lever preventing scratching of the floor, and two pieces of Velcro 42 (FIG. 4) approximately ½ inch wide by 2 inches long which are attached to both sides of top edge 44 (FIG. 4). 1½ inches in at corners with one piece of Velcro stitched on one side and one piece stitched on the other side at opposite sides attached together to form the wrap 64 (FIG. 6), a narrow piece of mesh 56 (FIG. 2) approximately 4 inches by 10½ inches is stitched at bottom edge to strengthen bottom edge, a wide piece of mesh 58 approximately 13 inches by 2 inches is attached to top edge to scrape off dirt from floor (FIG. 6) and a bottom mopping section 62 (FIG. 4) that rests on the floor when mopping. To make mop head 76 (FIG. 6) using a cloth material preferably terry cloth towel material having first and second sides, of a rectangular pattern with a top edge 44 (FIG. 2) and a bottom edge 42 (FIG. 2) of preferably 13 inches and sides of preferably 24 inches, dividing the pattern into four adjacent panels of about 6 inches (FIG. 1), a first panel starting at the top edge 44 and a fourth panel ending at the bottom edge 42 adding on one side approximately 5½ inches by 12½ inches preferably terry cloth toweling doubled over on itself to form a padded section on the second panel positioned evenly in the middle, folding over the bottom outer corners 48 (FIG. 3) to approximately 3 inches down on one side and attaching the outer corners of the fourth panel to the side of the material so as to form an attachment flap 60 (FIG. 3) at bottom end of the pattern for attaching the towel to a mop handle 70 attachment mechanism on a mop handle, folding the fourth and third panels approximately 3¾ inches 50 (FIG. 4) down from top edge, stitching 82 together the open side edges 78 of the second panel to the open side edges of the third panel (FIG. 4) so as to form a double thickness mopping section, reversing the mopping section inside out to as to expose the other side thereof then stitching across and down flap 66 (FIG. 5) folding over on the other side the top corners 46 (FIG. 6) of the first panel to approximately a point of meeting so as to divide the top edge 444 of the pattern at its center into a pair of edge abutting securing flaps (FIG. 6) for securing the towel about the mop handle (FIG. 6). Attaching the abutting edges of the securing flaps 1½ inches inward 84 (FIG. 6) from top outer corners 46 (FIG. 6) and with Velcro 52 (FIG. 6) a closing mechanism for closing the securing flaps around the mop handle, attaching one piece of Velcro on one side of the top outer corners and one piece of Velcro on the other side of the top outer corners both pieces of Velcro attached approximately 1½ inches in from top outer corners 46 (FIG. 6) at opposite corners, a piece of mesh 58 approximately 4 inches by 12½ inches is stitched at the top edge 68 (FIG. 6) on right side then the mesh is turned down to rest over flap and mesh is stitched down at sides 78 inward 2½ inches (FIG. 6), leaving an opening 80 (FIG. 2) of the wrap and an opening on bottom under mesh 58 to insert the mop handle to the mop head (FIG. 8).

To mount the mop head 76 to mop handle 70 the mop handle is fitted under wrap 64 out through top edge 44 at opening 80 then lever 74 on mop handle 70 is opened and flap 60 is secured inside spring 72 then lever 74 is closed securing mop head 76 to handle 70.

To dismount mop head 76 from the handle 70 Velcro 52 is pulled open and lever 74 is opened releasing spring 72 then flap 60 is pulled out of spring 72 releasing mop head 76 and mop handle 70 is slipped out of opening 80.

I claim:

1. A method of making a mop head comprising the steps of:

a) providing a rectangular cloth material having first and second ends;

b) folding over the outer corners of the cloth material at the second end thereof to form a pair of attachment flaps;

c) folding the cloth material between the ends thereof about a fold line such that the attachment flaps formed in the prior step are located between the fold line and the first end thereof;

d) securing portions of the cloth material between the fold line and the attachment flaps to form a double thickness mopping section;

e) reversing the mopping section by turning it inside out to form a pocket;

f) securing layers of the pocket formed in the prior step; and g) folding over the corners of the cloth material at the first end thereof to form a pair of triangular securing flaps for securing the mop head about a mop handle and attaching abutting portions of the securing flaps.

2. A mop head attachable to a handle with an attachment mechanism, the mop head comprising:

a rectangular piece of cloth material having first and second ends with the corners at the second end being folding over to form a pair of attachment flaps and the cloth further being folded between the ends thereof about a fold line such that the attachment flaps are positioned between the fold line and the first end thereof, portions of the cloth material between the fold line and the attachment flaps being secured to form a double thickness mopping section, the mopping section being turned inside out to form a pocket and layers of the pocket being secured to each other and further wherein the corners of the cloth material at the first end thereof are folded to form a pair of triangular securing flaps for securing the mop head about the mop handle with abutting portions of the securing flaps being secured.

* * * * *